US007832436B2

(12) United States Patent
Strother

(10) Patent No.: US 7,832,436 B2
(45) Date of Patent: Nov. 16, 2010

(54) MOVABLE BLADE UNIT FOR WOOD CUTTING MACHINE

(75) Inventor: Michael Jeffrey Strother, P.O. Box 44-2049, Taipei (TW) 10668

(73) Assignees: Kuang Yung Machinery Co., Ltd., Taichung County (TW); Michael Jeffrey Strother (GB)

( * ) Notice: Subject to any disclaimer, the term of this patent is extended or adjusted under 35 U.S.C. 154(b) by 86 days.

(21) Appl. No.: 12/385,021

(22) Filed: Mar. 30, 2009

(65) Prior Publication Data

US 2010/0243106 A1 Sep. 30, 2010

(51) Int. Cl.
*B27C 1/00* (2006.01)

(52) U.S. Cl. ..... 144/237; 407/31; 83/498; 83/504; 83/508.3; 83/676

(58) Field of Classification Search ..... 144/218, 144/231–233, 237; 407/31; 83/495, 496, 83/498, 504, 508.2, 508.3, 698.41, 698.42, 83/698.51, 663, 664, 676
See application file for complete search history.

(56) References Cited

U.S. PATENT DOCUMENTS 5,433,563 A * 7/1995 Velepec ..... 409/234
5,996,659 A * 12/1999 Burgess ..... 144/347
7,520,305 B2 * 4/2009 Churchland et al. ..... 144/218

* cited by examiner

*Primary Examiner*—Shelley Self

(57) ABSTRACT

A movable blade unit for wood cutting machine is mounted to the rotating shaft of the wood cutting machine and includes a blade and an inner ring which is located between the blade and the rotating shaft. A movable ring is connected to the movable blade unit and includes a flange, an outer collar and the inner ring, wherein the flange is connected to the outer collar which is rotatably connected to the inner ring. The inner ring is mounted to the rotating shaft and a gap is defined between the inner ring and the rotating shaft. The inner ring includes multiple sets of rotating members which are in contact with the grooves in the rotating shaft so that the inner ring is rotatable and movable relative to the rotating shaft with little or reduced friction.

9 Claims, 7 Drawing Sheets

MOVABLE BLADE UNIT FOR WOOD CUTTING MACHINE

BACKGROUND OF THE INVENTION (1) Field of the Invention

The present invention relates to a movable blade unit of wood cutting machine, and more particularly, to a movable blade unit which is smoothly movable along the rotating shaft with less friction.

(2) Description of the Prior Art

A conventional wood cutting machine includes an axle to which multiple blades are mounted so as to cut the wood object into multiple pieces. The distance between the blades can be adjusted. A movable blade unit is provided to meet different requirements of cutting and the blade on the movable blade unit can avoid from knots of the wood object or to cut along the terrain sides of the wood object to obtain the maximum use of the wood object.

The conventional wood cutting machine is shown in FIGS. 1 to 3, and generally includes an axle 10 and a rotating shaft 11 is connected to the axle 10, multiple blades 12 are mounted to the rotating shaft 11 by using a positioning ring 13 which is mounted to the rotating shaft 11. A hydraulic expansion mechanism in the rotating shaft 11 firmly positions the positioning ring 13 so that the blades 12 and the positioning ring 13 are co-rotated with the rotating shaft 11. Some machines may directly fix the blades 12 to the rotating shaft 11.

The rotating shaft 11 has at least one movable blade 16 which is connected to a movable ring 17. The at least one movable blade 16 and the movable ring 17 are located with another positioning ring 161 which is made from bronze copper and has multiple grooves so as to be engaged with transmission keys 15 on the rotating shaft 11. The positioning ring 161 is directly in contact with the rotating shaft 11 and movable axially along the rotating shaft 11 by moving the movable ring 17. The movable ring 17 has a flange 171 radially connected thereto and a bearing 172 is located between the flange 171 and the positioning ring 161. The users may move the flange 171 to move the movable ring 17. A bracket 173 is connected to the flange 171 and a measuring unit is used to detect the distance that the bracket 173 moves.

The at least one movable blade 16 is moved to a desired distance by operation of the flange 171 and the bracket 173 is then set at the desired position. The at least one movable blade 16 is then fixed and ready to cut.

The positioning ring 161 and the rotating shaft 11 has to be precisely matched to each other, while the positioning ring 161 has to be able to move smoothly on the rotating shaft 11. Therefore, the positioning ring 161 has to be made of bronze which is expensive. The contact friction between the positioning ring 161 and the rotating shaft 11 wears both and increases a gap between the positioning ring 161 and the rotating shaft 11. Dust and powder of the wood object can easily enter the enlarged gap to impede the movement of the movable ring 17.

There are several obvious drawbacks for the conventional movable ring 17. The gap between the positioning ring 161 and the rotating shaft 11, the machining precision for the bronze made positioning ring 161 is costly, and the wearing to the positioning ring 161 reduces the service of the positioning ring 161.

The present invention intends to provide a movable blade unit for wood cutting machines, wherein the drawbacks seen on the conventional movable ring are improved.

SUMMARY OF THE INVENTION

The present invention relates to a moveable blade unit for wood cutting machines, and the blade unit comprises an axle having a rotating shaft which includes multiple grooves defined axially therein. Multiple first blades are connected to at least one first positioning collar which is mounted to the rotating shaft. A movable blade unit is mounted to the rotating shaft and includes a second blade and an inner ring which is located between the second blade and the rotating shaft. A movable ring is connected to the movable blade unit and has a flange, an outer collar and the inner ring. The flange is connected to the outer collar which is rotatably connected to the inner ring by a bearing. The inner ring is mounted to the rotating shaft and a gap is defined between the inner ring and the rotating shaft. Multiple sets of rotating members are connected to an inner periphery of the inner ring and in contact with the grooves in the rotating shaft.

The primary object of the present invention is to provide a movable blade unit for a wood cutting machine, wherein the inner ring of the movable blade unit contacts the rotating shaft through rotating bearings located in the axial grooves, thus reducing friction.

Another object of the present invention is to provide a movable blade unit for a wood cutting machine, wherein the inner ring of the movable blade unit includes the fan blade impeller which induces airflow and thus blows the dust and powder away from the inner ring and axial grooves during use.

Yet another object of the present invention is to provide a movable blade unit for a wood cutting machine, wherein the movable blade unit is easily manufactured and maintained with less cost.

The present invention will become more obvious from the following description when taken into account with the accompanying drawings which show, for purposes of illustration only, a preferred embodiment in accordance with the present invention.

DETAILED DESCRIPTION OF THE PREFERRED EMBODIMENTS

Figure 1:
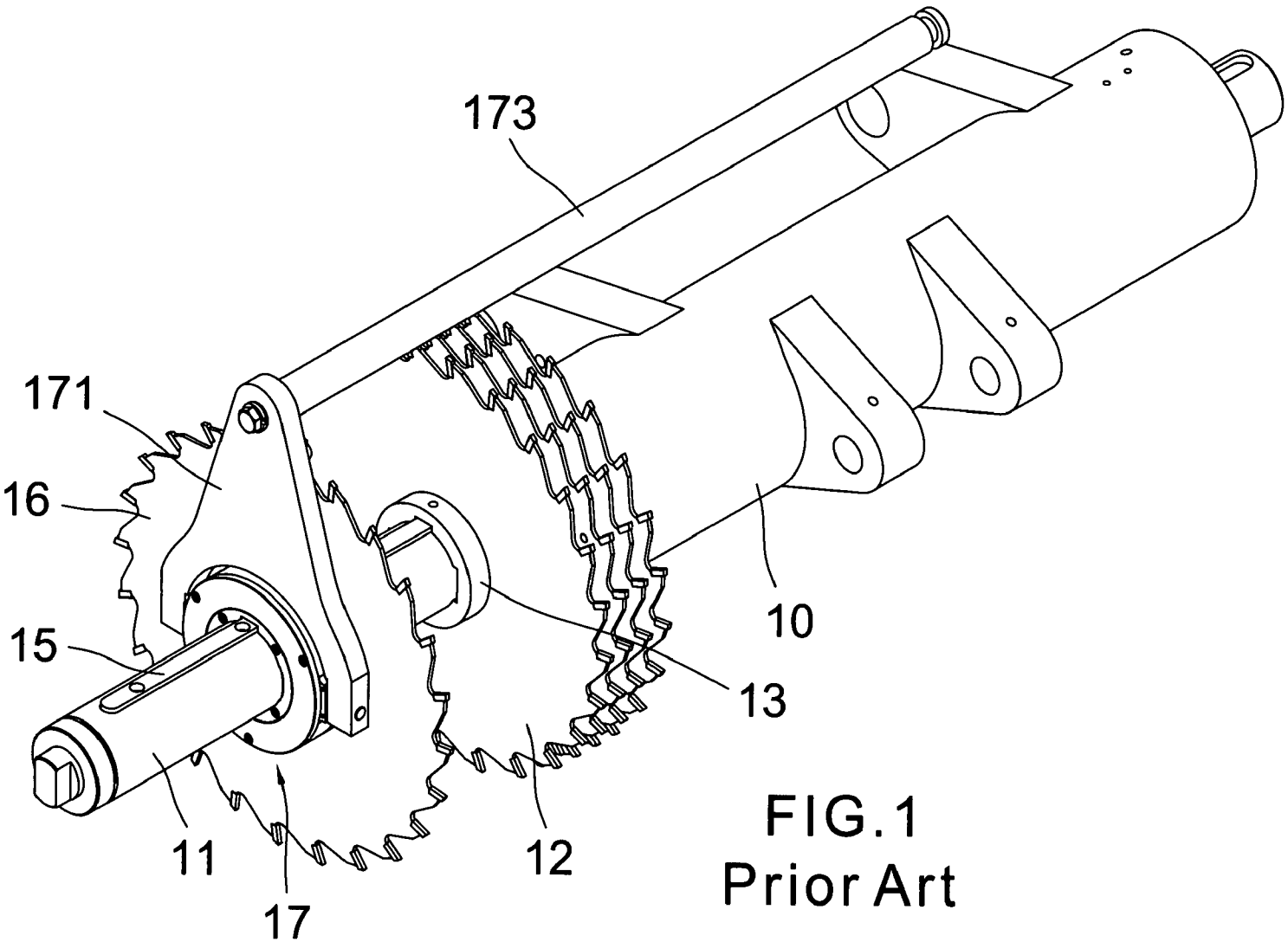
FIG.1 Prior Art
FIG. 1 is a perspective view to show the conventional movable blade unit of wood cutting machine.
Figure 2:
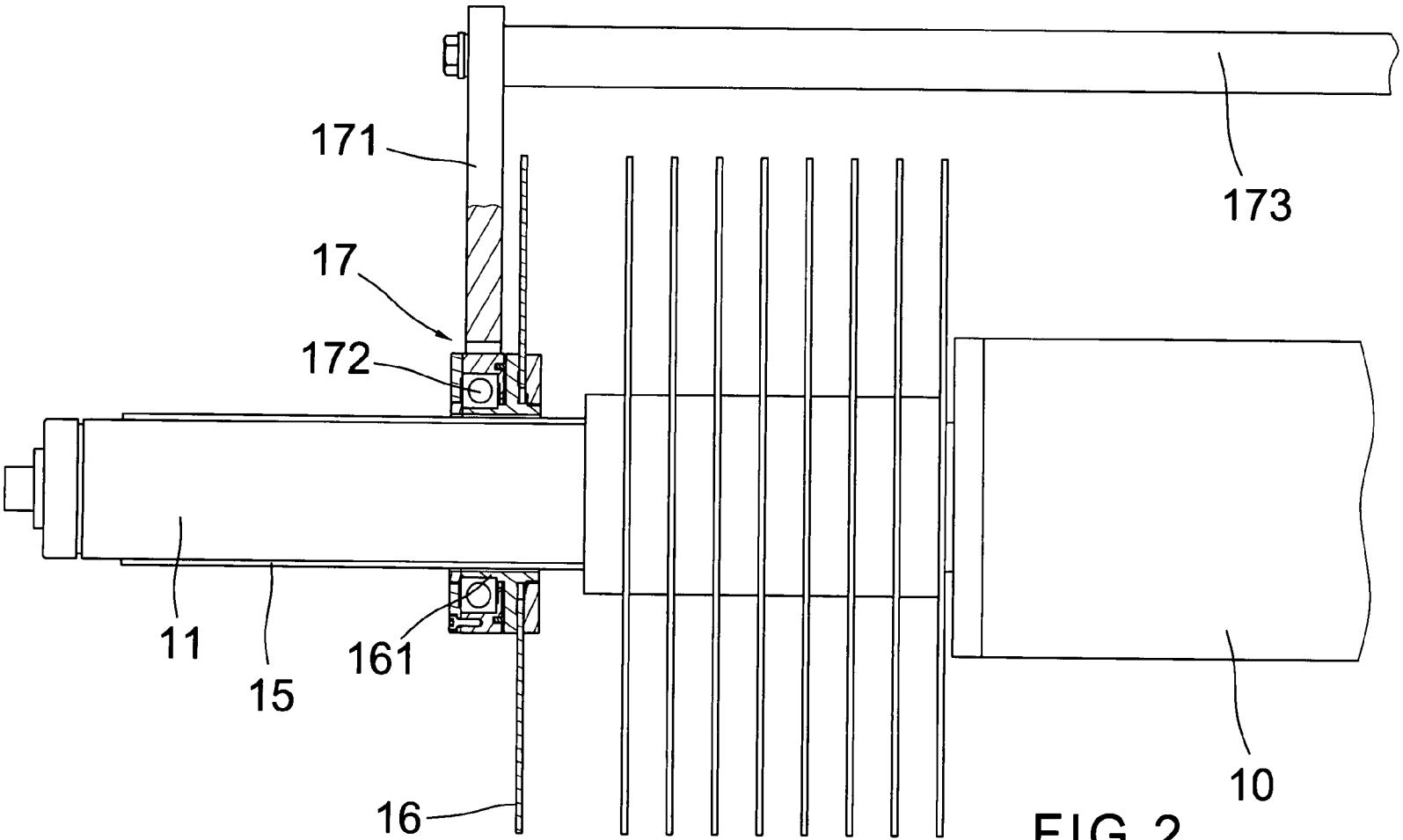
FIG.2 Prior Art
FIG. 2 is a partial cross sectional view to show the conventional movable blade unit of wood cutting machine.
Figure 3:
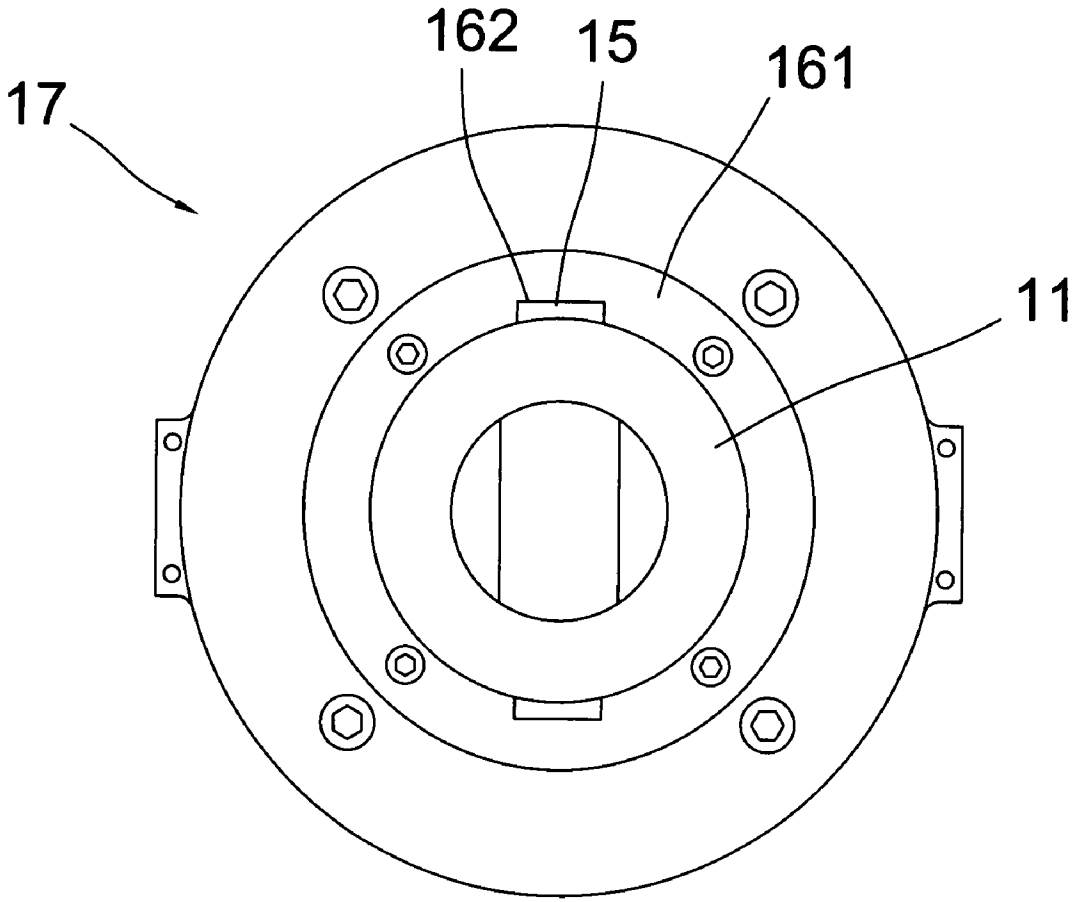
FIG.3 Prior Art
FIG. 3 is an end view to show the movable ring of the conventional movable blade unit of wood cutting machine.
Figure 4:
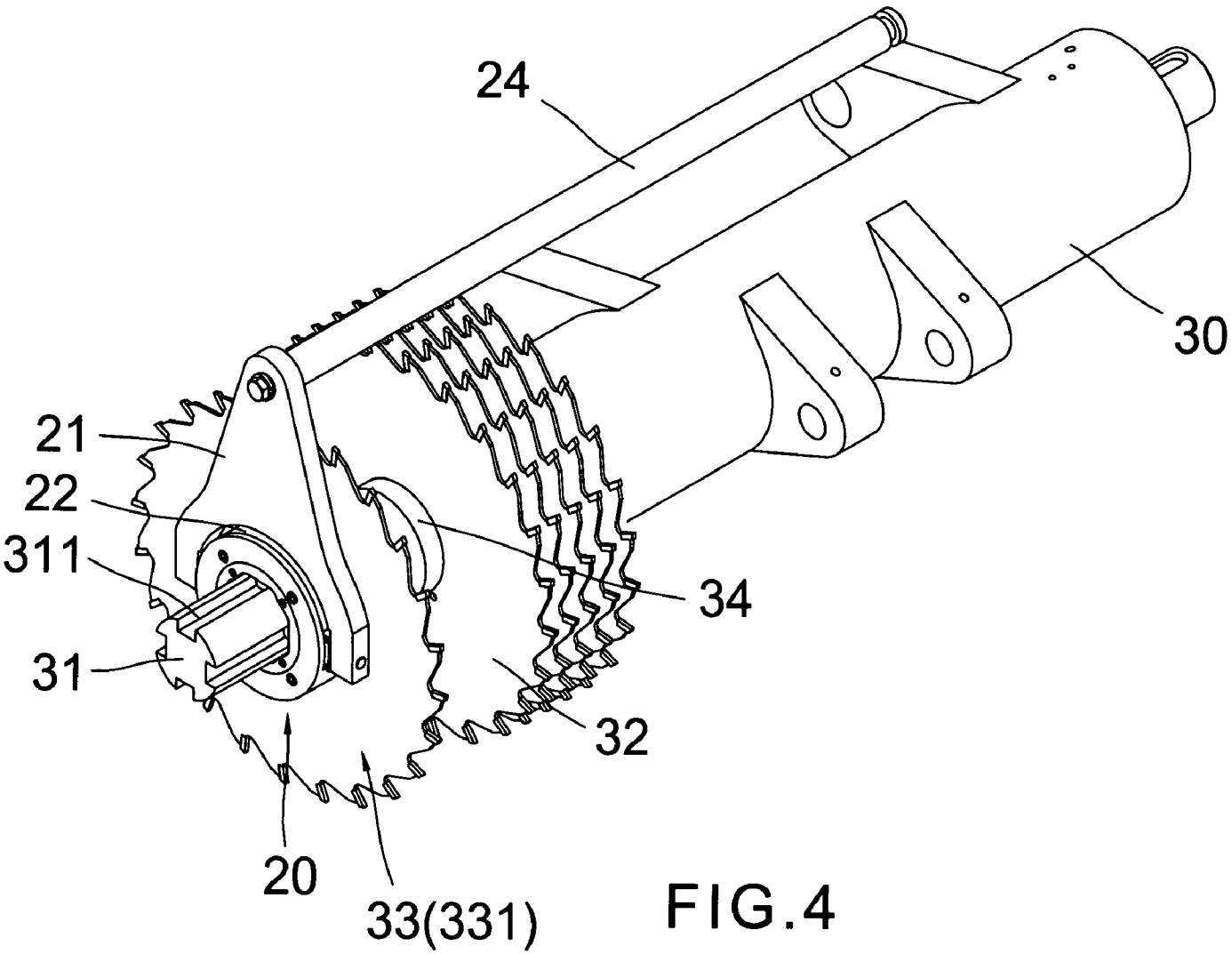
FIG. 4 is a perspective view to show the movable blade unit of wood cutting machine of the present invention.
Figure 5:
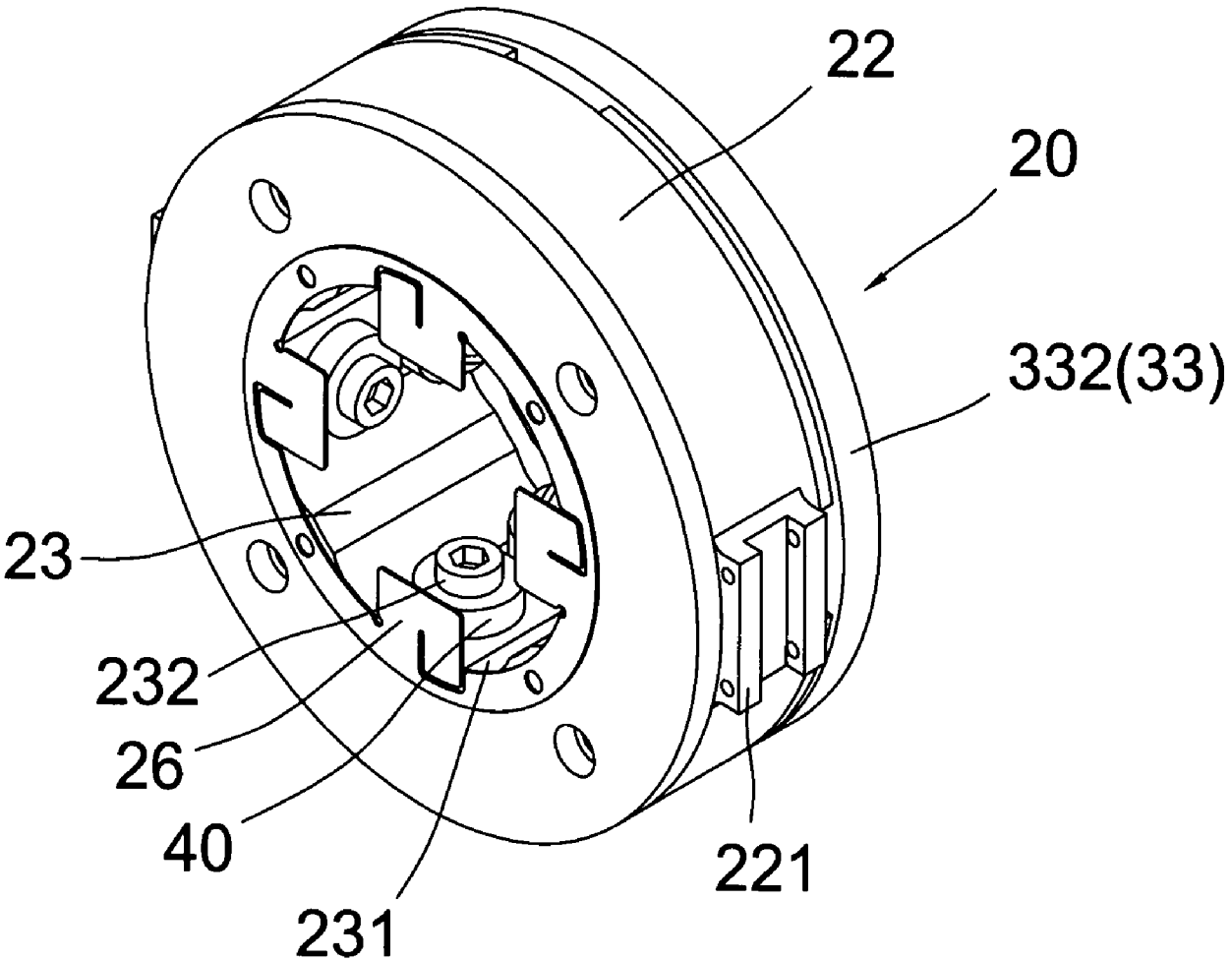
FIG. 5 is a perspective view to show the inner ring of the movable blade unit of the present invention.
Figure 6:
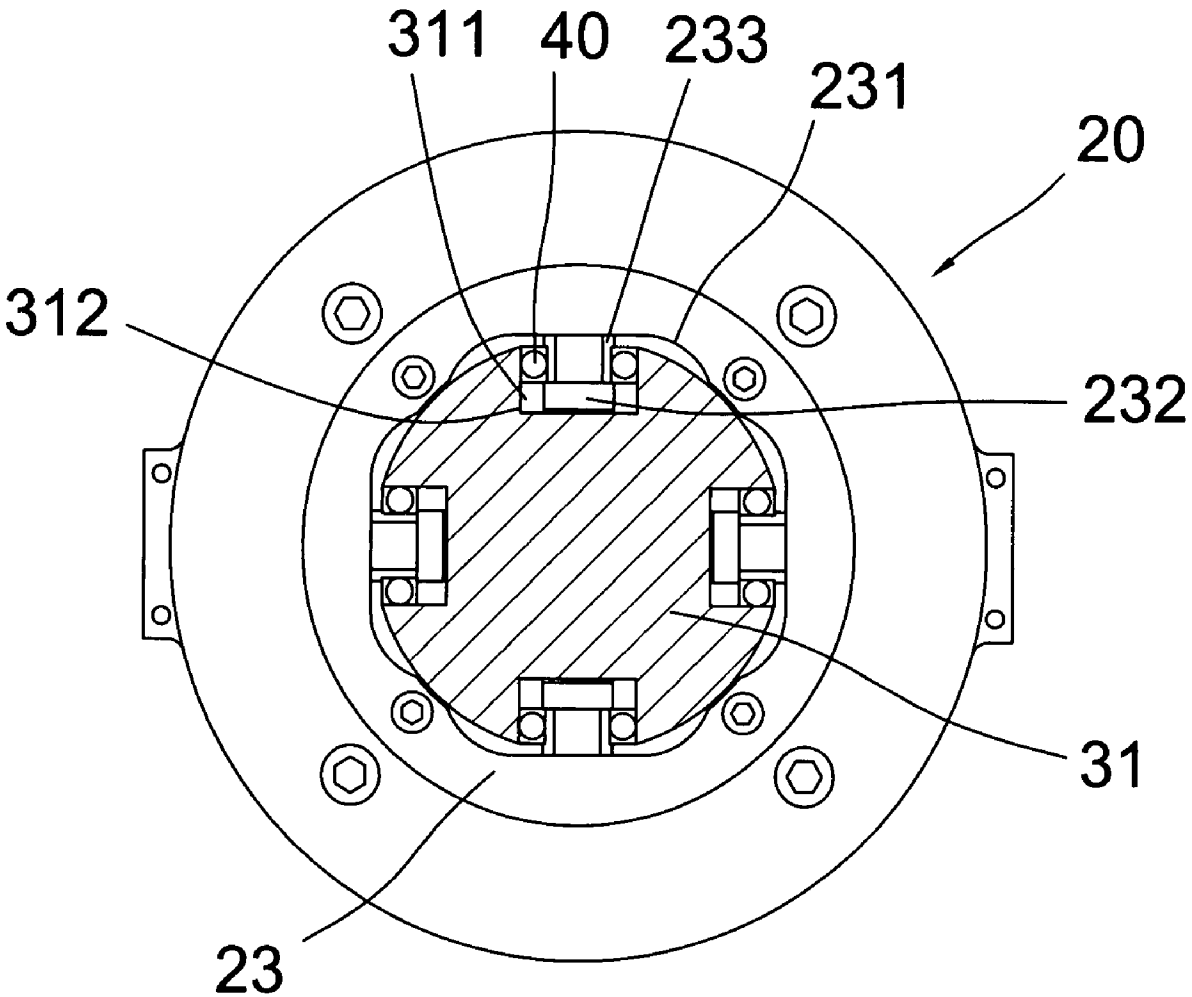
FIG. 6 is a partial cross sectional view to show the relationship of the rotating shaft and the inner ring of the present invention.

Referring to FIGS. 4 to 7, the blade unit for wood cutting machine of the present invention comprises an axle 30 which is a rotating shaft 31 driven by a motor (not shown) and multiple grooves 311 are defined axially therein. In this embodiment, there are four grooves 311 and each groove 311 is a substantially U-shaped groove and includes two sidewalls 312.

Multiple first blades 32 are connected to at least one first positioning collar 34 which is mounted to the rotating shaft 31. The rotating shaft 31 includes a screw mechanism (not shown) which firmly positions the first positioning collar 34 so that the first blades 32 and the first positioning collar 34 are co-rotated with the rotating shaft 31.

A movable blade unit 33 is mounted to the rotating shaft 31 and includes a second blade 331 and an inner ring 23 which is located between the second blade 331 and the rotating shaft 31. The movable blade unit 33 is connected to the inner ring 23 by a second positioning collar 332 and the inner ring 23 is mounted to the rotating shaft 31.

Figure 7:
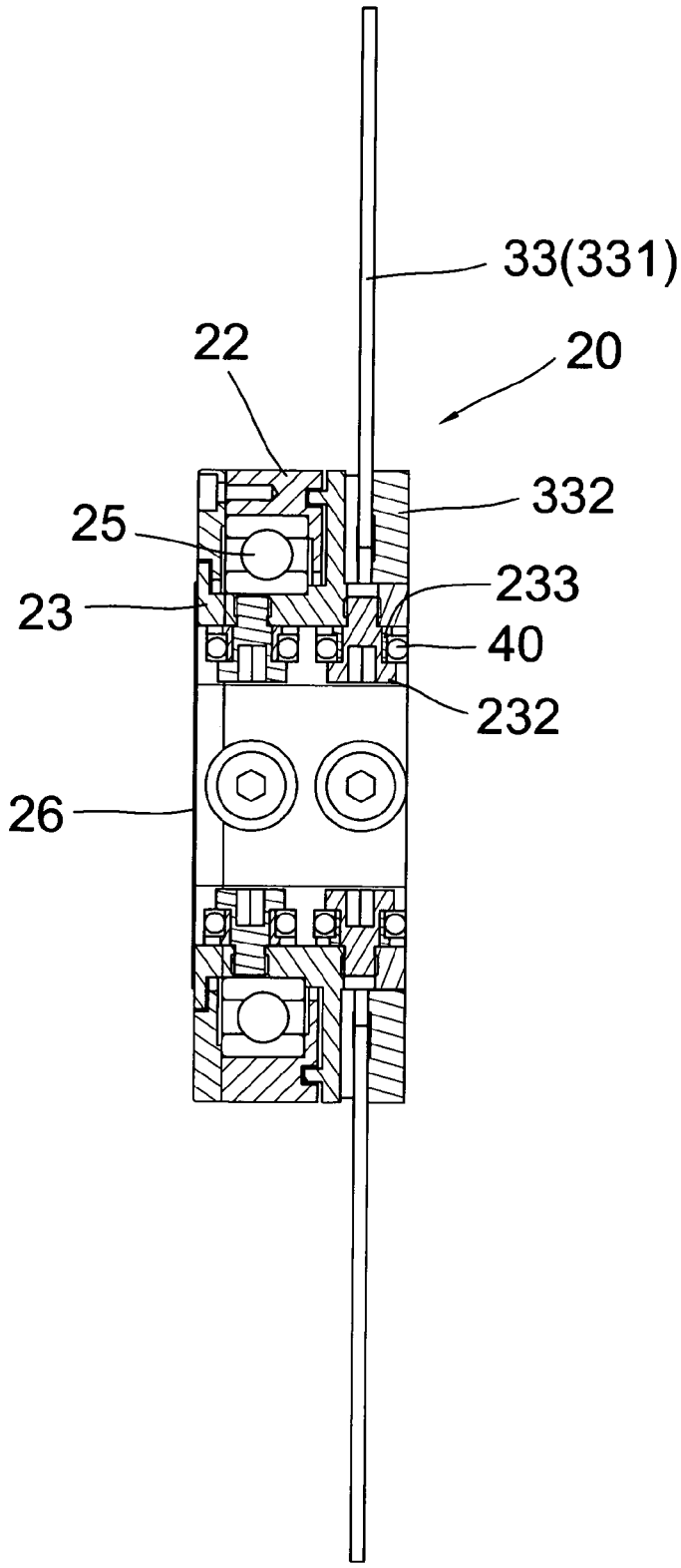
FIG. 7 is a cross sectional view to show the movable blade unit of wood cutting machine of the present invention.

A movable ring 20 is connected to the movable blade unit 33 and has a flange 21, an outer collar 22 and the inner ring 23. The flange 21 is connected to connection members 221 on the outer collar 22 which is rotatably connected to the inner ring 23. A piston 24 is connected to the flange 21 and the wood cutting machine includes a measuring unit (not shown) which can detect the distance that the piston 24 moves. A bearing 25 is located between the outer collar 22 and the inner ring 23 as shown in FIG. 7. The inner ring 23 and the second positioning collar 332 are moved and rotated simultaneously. The inner ring 23 is mounted to the rotating shaft 31 and a gap is defined between the inner ring 32 and the rotating shaft 31. Multiple sets (minimum is 8) of rotating members 40 are connected to an inner periphery of the inner ring 23 and in contact with the grooves 311 in the rotating shaft 31. In this embodiment, there are eight sets of rotating members 40 connected to the inner periphery of the inner ring 23 and each set includes two rotatable pieces. Correspondingly, the rotating shaft 31 includes four grooves 311.

The inner periphery of the inner ring 23 includes four flat surfaces 231 which are located at equal intervals. Each flat surface 231 includes a post 232 extending therefrom which is perpendicular to the flat surface 231. Each post 232 has a nylatron bush 233 mounted thereto and the rotation members 40 are mounted to the nylatron bushes 233 on the posts 232 respectively and are rotatable on the sidewalls 312 of the grooves 311. In this embodiment, each of the rotating members 40 is a bearing. It is noted that the inner periphery of the inner ring 23 does not directly contact with the rotating shaft 31 and multiple fan blades 26 are connected to outside of the inner ring 23. The fan blades 26 rotate when the rotating shaft 31 rotates so as to generate air flow to blow the dust the powder during operation of the wood cutting machine.

When in use, the user moves the lever 24 to push the flange 21 which moves the movable ring 20 such that the movable blade unit 33 is moved with the movable ring 20 to a desired position. The user then sets the lever 24 and fixes the movable blade unit 33. The first blades 32 and the second blade 331 are co-rotated with the rotating shaft 31.

The rotating shaft 31 drives the first positioning collar 34 which rotates the first blades 32 and the rotating shaft 31 simultaneously drives the movable blade unit 33 to rotate the second blade 331. Because of the bearing 25 located between the outer collar 22 and the inner ring 23, and the restriction of the lever 24, the outer collar 22 does not rotate with the rotating shaft 31.

The rotating members 40 roll on the sidewalls 312 of the groove 311 so that the inner ring 23 can be smoothly moved along rotating shaft 31. In other words, the movable ring 20 moves the movable blade unit 33 smoothly. Because of the relatively large gap between the inner ring 23 and the rotating shaft 31, the friction therebetween does not exist. The rotating members 40 are easily maintained and it is not necessary for these to be manufactured precisely. Once they are set, the movable blade unit 33 can be precisely set and operated. The fan blades 26 expel the dust the powder during cutting wood objects to keep the smooth movement of the movable blade unit 33.

While we have shown and described the embodiment in accordance with the present invention, it should be clear to those skilled in the art that further embodiments may be made without departing from the scope of the present invention.

What is claimed is:

1. A blade unit for wood cutting machine, comprising:

an axle being a rotating shaft;

multiple first blades connected to at least one first positioning collar which is mounted to the rotating shaft, the rotating shaft including multiple grooves defined axially therein;

a movable blade unit mounted to the rotating shaft and including a second blade and an inner ring which is located between the second blade and the rotating shaft, and a movable ring connected to the movable blade unit and having a flange, an outer collar and the inner ring, the flange connected to the outer collar which is rotatably connected to the inner ring, the inner ring mounted to the rotating shaft and a gap defined between the inner ring and the rotating shaft, multiple sets of rotating members connected to an inner periphery of the inner ring and being in contact with the grooves in the rotating shaft.

2. The movable blade unit as claimed in claim 1, wherein four sets of rotating members are connected to the inner periphery of the inner ring and each set includes two rotatable pieces, the rotating shaft includes four grooves.

3. The movable blade unit as claimed in claim 2, wherein the inner periphery of the inner ring includes four flat surfaces which are located at equal intervals, each flat surface includes a post extending therefrom which is perpendicular to the flat surface, nylatron bushes are mounted to the posts and the rotating members are mounted to the nylatron bushes.

4. The movable blade unit as claimed in claim 1, wherein each of the rotating members is a bearing.

5. The movable blade unit as claimed in claim 1, wherein each of the grooves is a substantially U-shaped groove and includes two sidewalls with which the rotation member is in contact.

6. The movable blade unit as claimed in claim 1, wherein the inner ring is connected to a second positioning collar of the movable blade unit.

7. The movable blade unit as claimed in claim 1, wherein a bearing is located between the outer collar and the inner ring.

8. The movable blade unit as claimed in claim 1, wherein the flange is connected to a lever.

9. The movable blade unit as claimed in claim 1, wherein multiple fan blades are connected to outside of the inner ring.

* * * * *